US007008083B2

(12) United States Patent
Leddusire

(10) Patent No.: US 7,008,083 B2
(45) Date of Patent: Mar. 7, 2006

(54) METHOD AND APPARATUS FOR LEVELING A SHADE

(75) Inventor: Ron Leddusire, Seattle, WA (US)

(73) Assignee: Dolan Northwest, LLC, Portland, OR (US)

( * ) Notice: Subject to any disclaimer, the term of this patent is extended or adjusted under 35 U.S.C. 154(b) by 0 days.

(21) Appl. No.: 10/722,748

(22) Filed: Nov. 26, 2003

(65) Prior Publication Data

US 2005/0111227 A1 May 26, 2005

(51) Int. Cl.
*F21V 1/00* (2006.01)

(52) U.S. Cl. ..... 362/351; 362/356; 362/433

(58) Field of Classification Search ..... 362/351, 362/355, 433, 356, 357
See application file for complete search history.

(56) References Cited

U.S. PATENT DOCUMENTS

| | | | | |
|---|---|---|---|---|
| 2,745,002 | A * | 5/1956 | Hoffmann | 362/433 |
| 4,414,618 | A * | 11/1983 | Jacobson | 362/417 |
| 4,493,011 | A * | 1/1985 | Spector | 362/96 |
| 4,633,378 | A * | 12/1986 | Reisman | 362/353 |
| 4,827,382 | A * | 5/1989 | Feliks | 362/35 |
| 6,227,680 | B1 * | 5/2001 | Arndt | 362/248 |

* cited by examiner

*Primary Examiner*—Laura K. Tso
(74) *Attorney, Agent, or Firm*—Marger Johnson & McCollom, P.C.

(57) ABSTRACT

Some embodiments of the invention significantly increase the safety of shades attached to light fixtures by allowing movement of the shade in all directions relative to a fixed light fixture while at the same time preventing the shade from coming too close to a light bulb. Some embodiments of the invention provide a method of leveling a shade by using the natural balancing point of the shade. Other embodiments of the invention are described in the claims.

22 Claims, 15 Drawing Sheets

METHOD AND APPARATUS FOR LEVELING A SHADE

BACKGROUND OF THE INVENTION

1. Technical Field of the Invention

This disclosure relates generally to lighting systems, components, and methods and more particularly to a method and apparatus for leveling a shade on a light fixture.

2. Description of the Related Art

FIGS. 1–5 are diagrams that illustrate the industry standard device for attaching a shade to a lighting fixture, in this case a lamp. Like reference numerals refer to like parts throughout. With reference to FIGS. 1–5, a base unit 2 of the lamp supports a switch/socket assembly 4 and a harp 8. A light bulb 6 may be inserted and removed from the switch/socket assembly 4 by screwing the base of the light bulb into the socket. A flattened portion at the top of the harp 8 supports a lamp washer 10 and a finial support 12.

The lamp washer 10 is typically crimped to the shaft of the harp 8 at two positions. Prior to crimping, a threaded end of the finial support 12 is inserted through a central hole in the middle of the lamp washer 10. The other end of the finial support 12 is flattened and keyed to engage the shaft of the harp 8. Consequently, when the lamp washer is crimped to the shaft of the harp 8, the threaded end of the finial support 12 is positioned perpendicularly to the shaft of the harp 8. The lamp washer 10 and the finial support 12 are rigidly connected. That is, a force applied to the finial support 12 causes the lamp washer 10 to move and vice versa. Additionally, the keyed end of the finial support 12 allows one to screw and unscrew a finial 14 (see FIG. 4) from the finial support 12 without causing the finial support 12 to rotate.

FIG. 3 illustrates a top, front, and side view of the harp 8, the lamp washer 10, and the finial support 12. The dotted lines in FIGS. 2 and 3 indicate that the lamp washer 10, and in turn the finial support 12, may rotate around the shaft of the harp 8 if enough rotational force is applied.

A rotational force is typically applied when there is a shade 16 attached to the lamp fixture by a finial 14, as shown in FIG. 4. Objects, pets, or people may physically contact the shade 16, thereby causing the shade 16, the finial 14, the finial support 12, and the lamp washer 10 to rotate around the axis of the harp 8, as illustrated in FIG. 5. Of course, if force is applied to the shade 16 in a direction parallel to the axis of the harp 8, rotation is prevented because the lamp washer 10 may only rotate in directions perpendicular to the harp axis. Thus, in these situations, the entire lamp tends to move.

Neither situation outlined above is desirable. In the first case, the shade 16 may stop in a position that is too close, or even touching, a hot light bulb 6. This is frequently the cause of many fires. In the second case, the shade 16, the harp 8, or the entire lamp may be damaged if the force applied to the shade is sufficient to overturn the lamp.

Furthermore, the more the shade 16 is jostled over time, the looser the connection between the lamp washer 10 and the harp 8 becomes. This is due to the fact that metal at the crimped portion of the lamp washer 10 is in direct contact with the harp 8. Thus, the metal will start to wear down with each rotation of the lamp washer 10, making the overall connection less stable.

Embodiments of the invention address these and other disadvantages of the conventional art.

DETAILED DESCRIPTION OF THE INVENTION

Figures 1, 2:
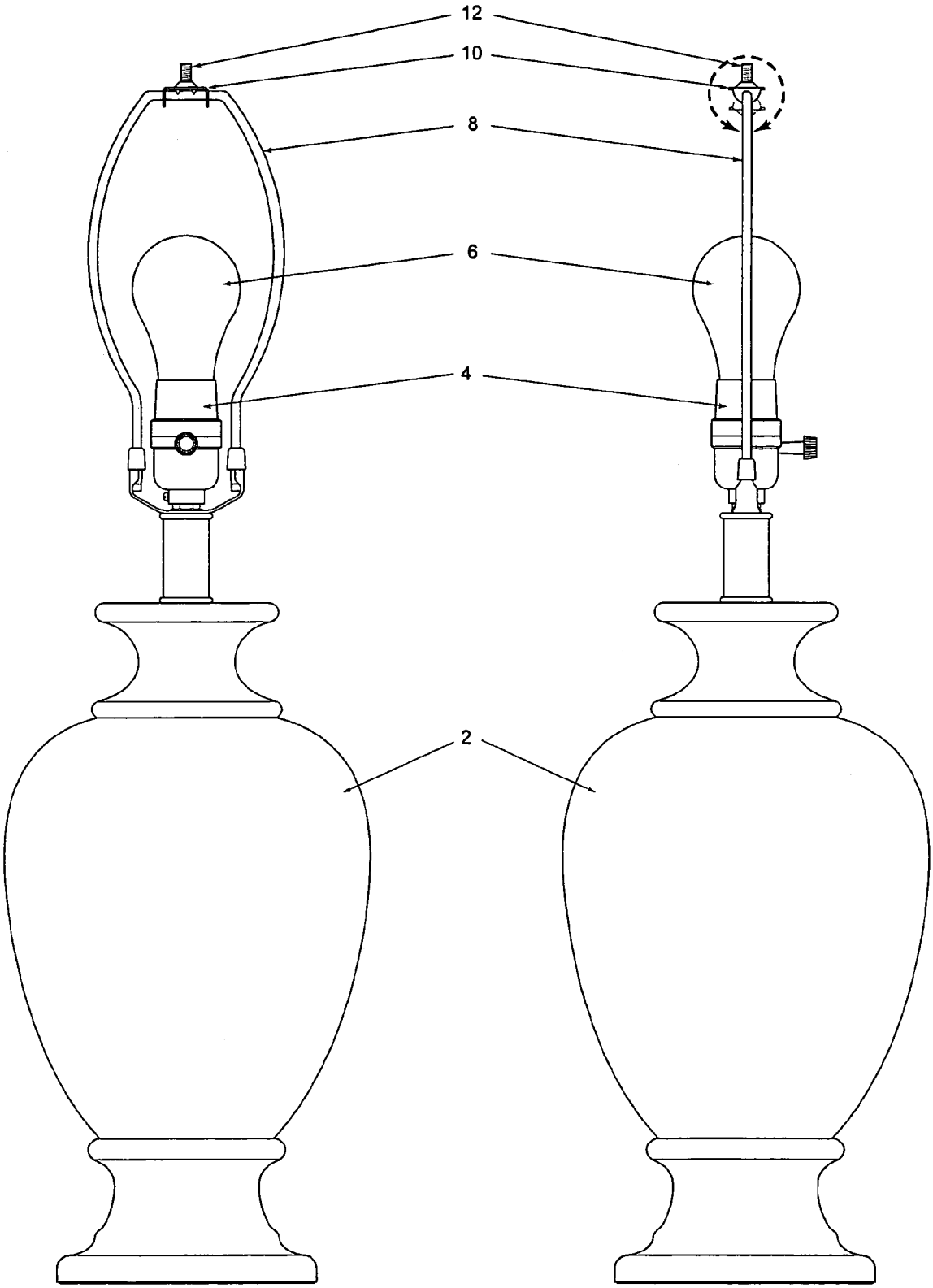
FIG. 1 (Prior art)
FIG. 2 (Prior art)
FIGS. 1–5 are diagrams illustrating a conventional lamp shade attachment device.

In the following detailed description of the invention, numerous exemplary embodiments of the invention are described. These embodiments are not limiting, but rather illustrate concepts of the invention that may be applied in many different embodiments. Thus, the scope of the invention should only be limited by the language of the appended claims. Throughout this detailed description, like reference numerals in the figures refer to like elements.

Figure 6A:
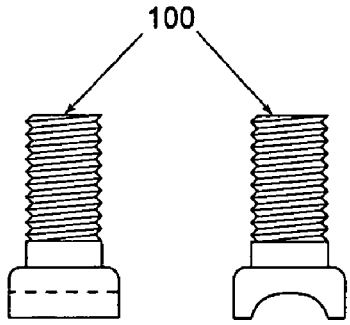
FIGS. 6A and 6B are diagrams illustrating the components of a shade leveler according to some embodiments of the invention.
Figure 6B:
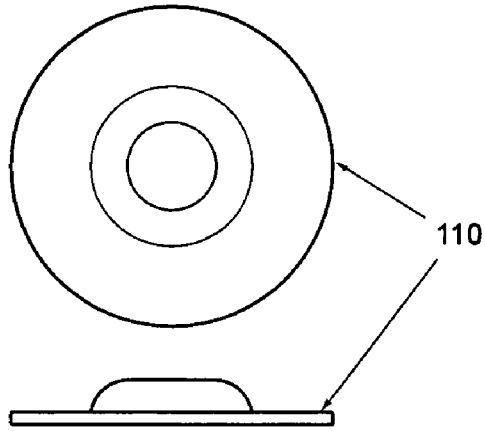

FIGS. 6A and 6B are diagrams illustrating the components of a shade leveler according to some embodiments of the invention.

Figure 4:
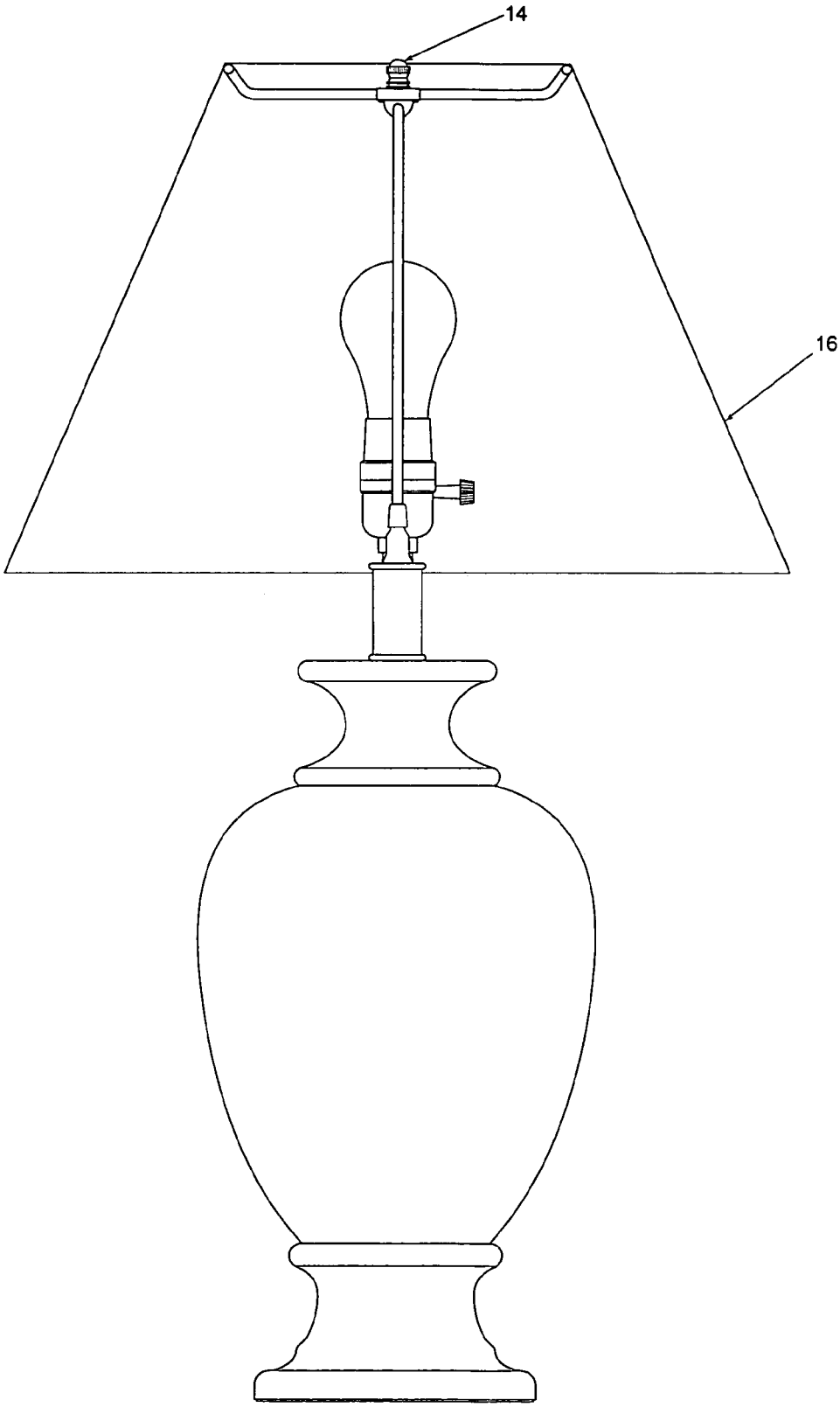
FIG. 4 (Prior art)
Figure 5:
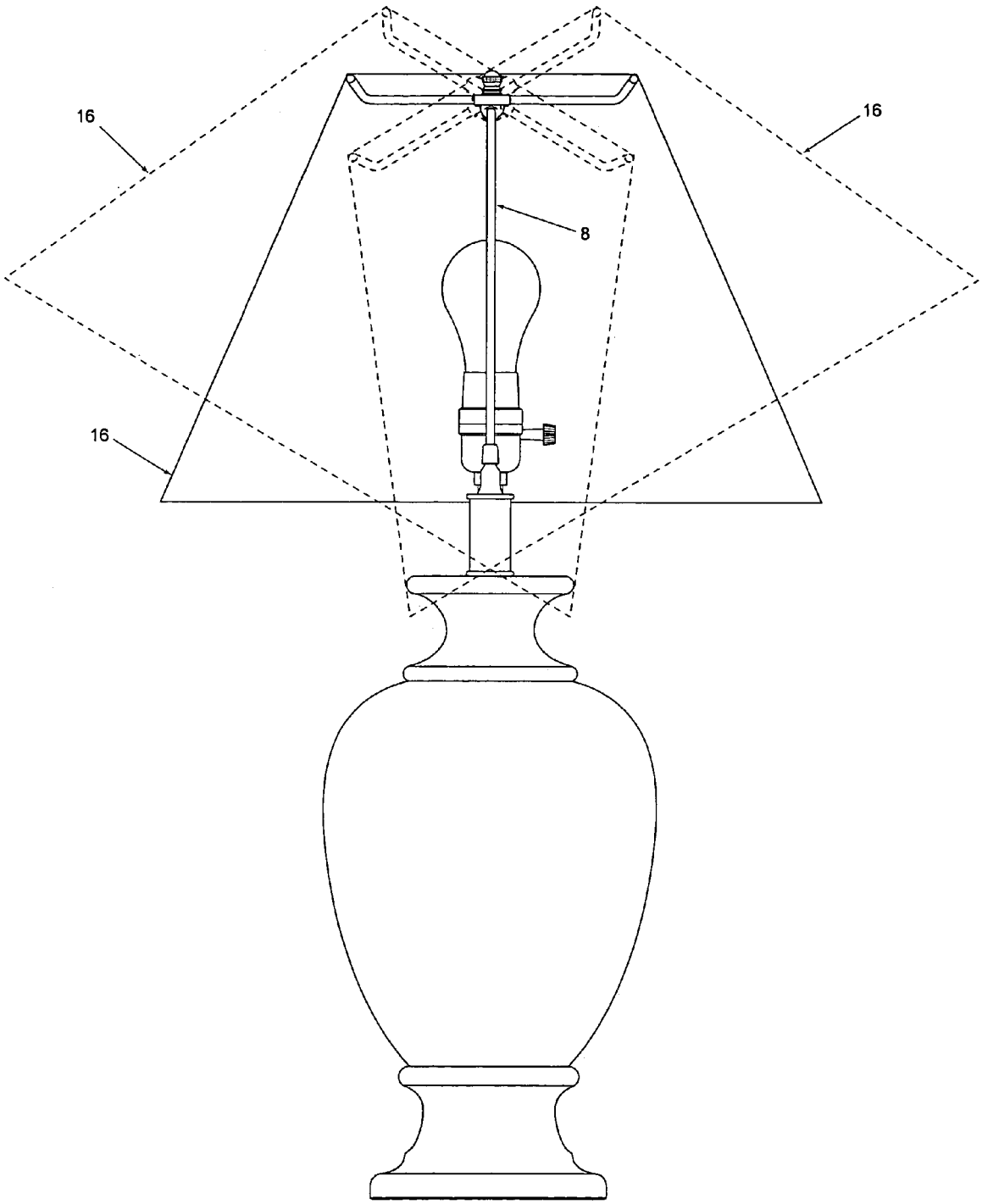
FIG. 5 (Prior art)

FIG. 6A is a diagram with two side views of a post 100. The bottom portion of the post 100 has a groove that corresponds to the curved shaft of the harp 8 (see FIGS. 7A and 7B). This grooved, or keyed, portion of the post 110 allows a finial 14 (see FIG. 4) to be screwed or unscrewed from the threads of the post without causing the post to rotate.

FIG. 6B is a diagram with a top view and a side view of a shade leveling ring 110. As seen in FIG. 6B, there is a hole in the central portion of the shade leveling ring 110. The inner, central portion of the shade leveling ring 110 is raised with respect to the outermost portion of the shade leveling ring 110.

The post 100 and the shade leveling ring 110 may be manufactured from any number of conventionally known materials such as metals, plastics, ceramics, or wood.

Figure 7A:
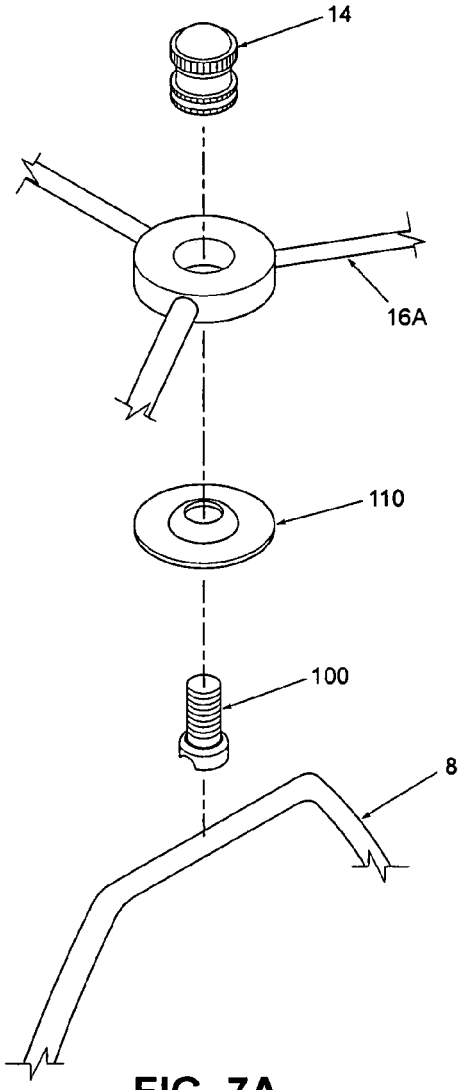
FIGS. 7A and 7B are diagrams illustrating how the shade leveler of FIG. 6 fits together in relationship to conventional lamp fixture components.
Figure 7B:
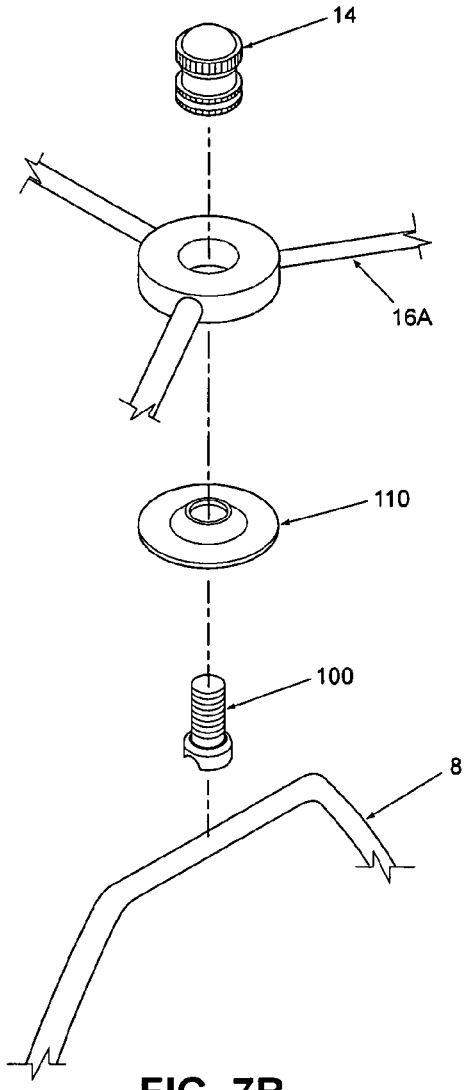

FIGS. 7A and 7B are diagrams illustrating how the shade leveler of FIG. 6 fits together in relationship to conventional lamp fixture components. The grooved end of the post 100 is placed against the horizontal portion of the harp 8. The shade leveling ring 110 is then placed over the post 100 so that the threaded end of the post goes through the hole in the shade leveling ring. Next, a shade bracket 16A from a conventional shade 16 (see FIG. 4) is laid over the shade leveling ring 110, such that the threaded end of the post 100 goes through the hole in the shade bracket 16A. Finally, the finial 14 is screwed onto the threaded end of the post 100. The finial 14 holds the shade bracket 16A against the shade leveling ring 110 and prevents the shade bracket 16A (and thus, the shade 16) from falling off the threaded end of the post 100.

The difference between FIGS. 7A and 7B is that in FIG. 7A the shade leveling ring 110 has a dome-shaped profile that is completely smooth while the shade leveling ring 110 of FIG. 7A has a dome-shaped profile with a raised edge at the uppermost portion of the dome.

Figure 8A:
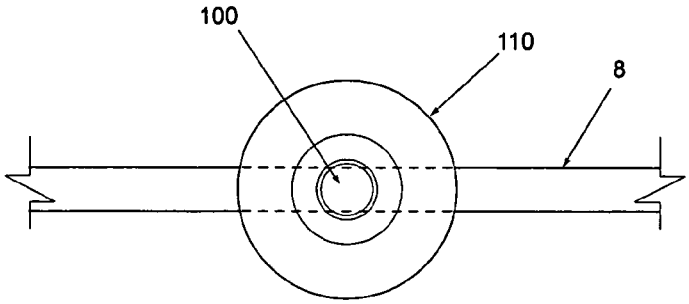
FIGS. 8A, 8B, and 8C are top, front, and side-view diagrams, respectively, which illustrate how the shade leveler of FIG. 6 is assembled in relationship to a conventional harp.
Figure 8B:
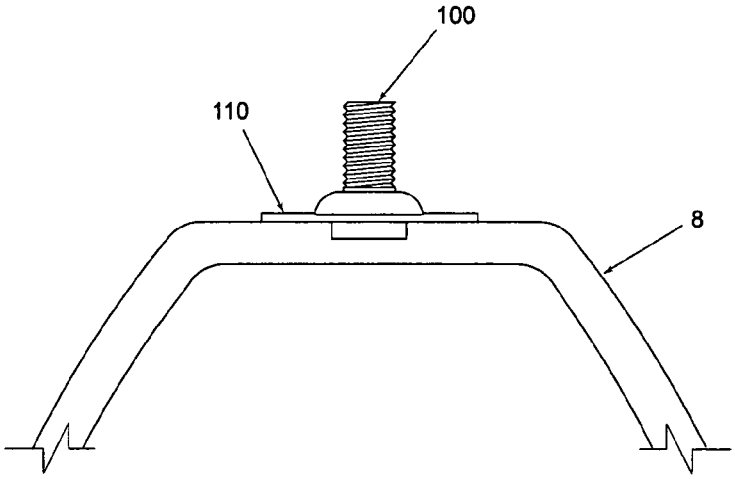
Figure 8C:
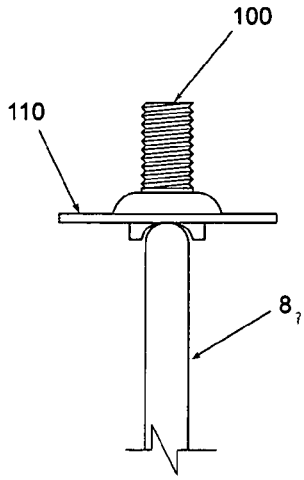

FIGS. 8A, 8B, and 8C are top, front, and side-view diagrams, respectively, which illustrate how shade levelers in accordance with some embodiments of the invention are assembled in relationship to a conventional harp. As seen in FIGS. 8A–8C, a portion of the flat, outer portion of the shade leveling ring 110 is in contact with the harp 8. At this junction between the harp 8 and the shade leveling ring 110, the shade leveling ring 110 is affixed to the harp 8. The shade leveling ring 110 may be permanently affixed to the harp 8 by any number of conventional methods, such as spot welding. The shade leveling ring 110 may also be detachably affixed to the harp 8 using any number of conventional methods, such as adhesive or screws. This would allow a damaged harp 8 or shade leveling ring 110 to be separately replaced.

Figure 9A:
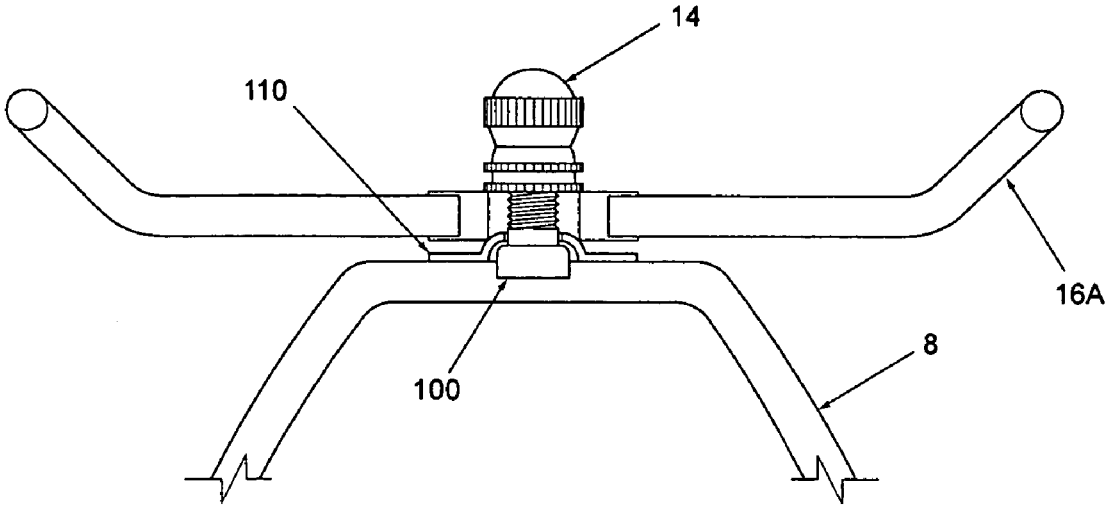
FIGS. 9A and 9B are front and side-view diagrams, respectively, illustrating how the shade leveler of FIG. 6 is positioned after the components shown in FIG. 7A are assembled.
Figure 9B:
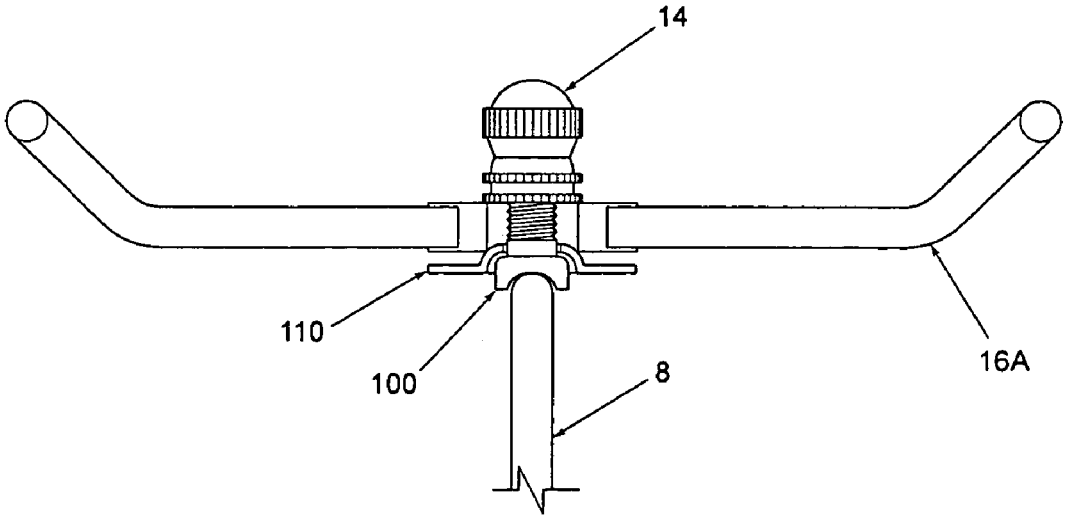

FIGS. 9A and 9B are front and side-view diagrams, respectively, illustrating how the shade leveler of FIG. 6 is positioned after the components shown in FIG. 7A are assembled. It is easily seen in FIGS. 9A and 9B how the dome-shaped portion of the shade leveling ring 110 contacts the circular edge on the bottom of the shade bracket 16A. When the finial 14 is tightened, the grooved portion of the post 100 contacts the harp 8 and prevents the post from rotating in the same direction that the finial is tightened. Similarly, the finial 14 may be loosened without rotating the post 100. However; the grooved portion of the post 100 is only loosely held against the harp 8 by the shade leveling ring 110. In other words, no portion of the post 100 is rigidly connected to the harp 8. Tightening the finial 14 only serves to hold the circular edge on the bottom of the shade bracket 16A more tightly to the dome-shaped portion of the shade leveling ring 110.

Figure 10A:
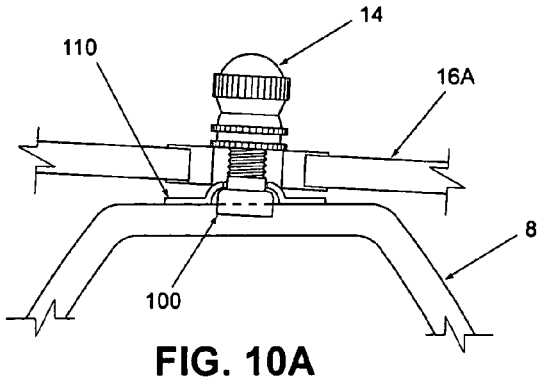
FIGS. 10A, 10B, 10C, and 10D are diagrams illustrating the operation of the shade leveler of FIG. 6 when a force is applied to a conventional shade that is attached to it.
Figure 10B:
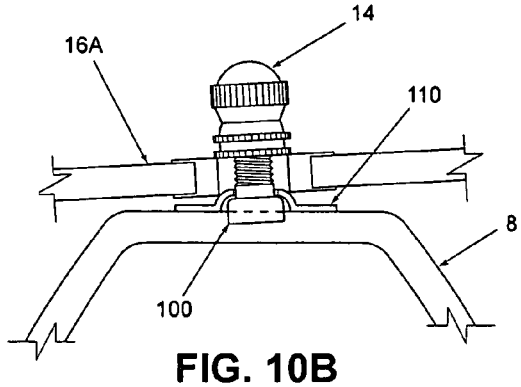
Figure 10C:
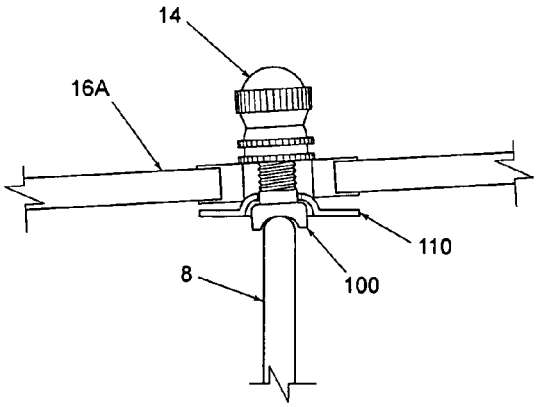
Figure 10D:
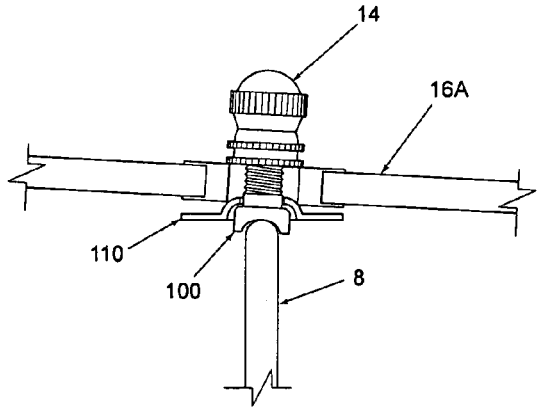

FIGS. 10A, 10B, 10C, and 10D are diagrams illustrating the operation of the shade leveler of FIG. 6 when a force is applied to a conventional shade 16 that is attached to it. This occurs when some object, pet, or person bumps or contacts the shade 16 (see FIG. 4). FIGS. 10A and 10B are front-view diagrams, and FIGS. 10C and 10D are side-view diagrams.

Figure 3A:
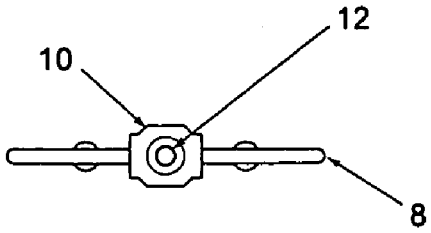
FIG. 3A (Prior art)
Figure 3B:
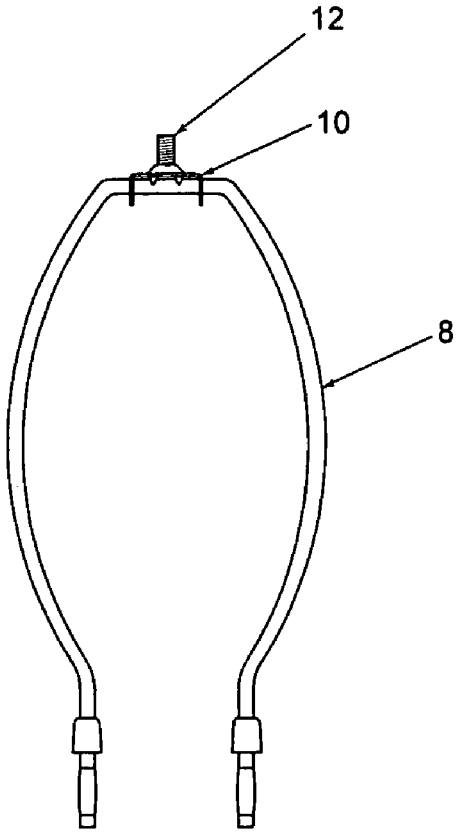
FIG. 3B (Prior art)
Figure 3C:
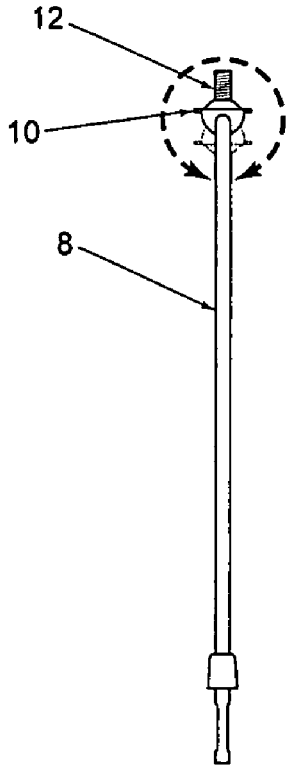
FIG. 3C (Prior art)

As seen in FIGS. 10A-10D, when a force is applied to the shade bracket 16A it causes the shade bracket 16A, the finial 14, and the post 100 to move in relationship to the shade leveling ring 110 and the harp 8. The dome-shaped portion of the shade leveling ring 110 allows the shade bracket 16A to slide over the dome in the direction of any applied force. This is a significant improvement over conventional devices, where movement of the shade 16 is limited to a rotational direction about the axis of the harp 8 (see FIGS. 2 and 3). With the dome-shaped profile of the shade leveling ring 110, force can be applied in all directions to the shade 16 and the shade 16 will move in that direction.

Furthermore, as mentioned above, only a tiny portion of the shade bracket 16A is in contact with the shade leveling ring 110. Thus, regardless of how tight the finial 14 is screwed onto the post 100, it is relatively easy to move the shade bracket 16A over the dome-shaped profile of the shade leveling ring 110.

In fact, when the finial 14 is merely tightened to the point where it prevents the shade bracket 16A from falling off the post 100, an additional advantage is achieved. The equally distributed weight of the shade 16 will cause the shade bracket 16A to seek a naturally balanced point on the shade leveling ring 110. Thus, if the shade 16 is bumped, the dome-shaped profile of the shade leveling ring 110 imparts a self-leveling action.

Figure 11:
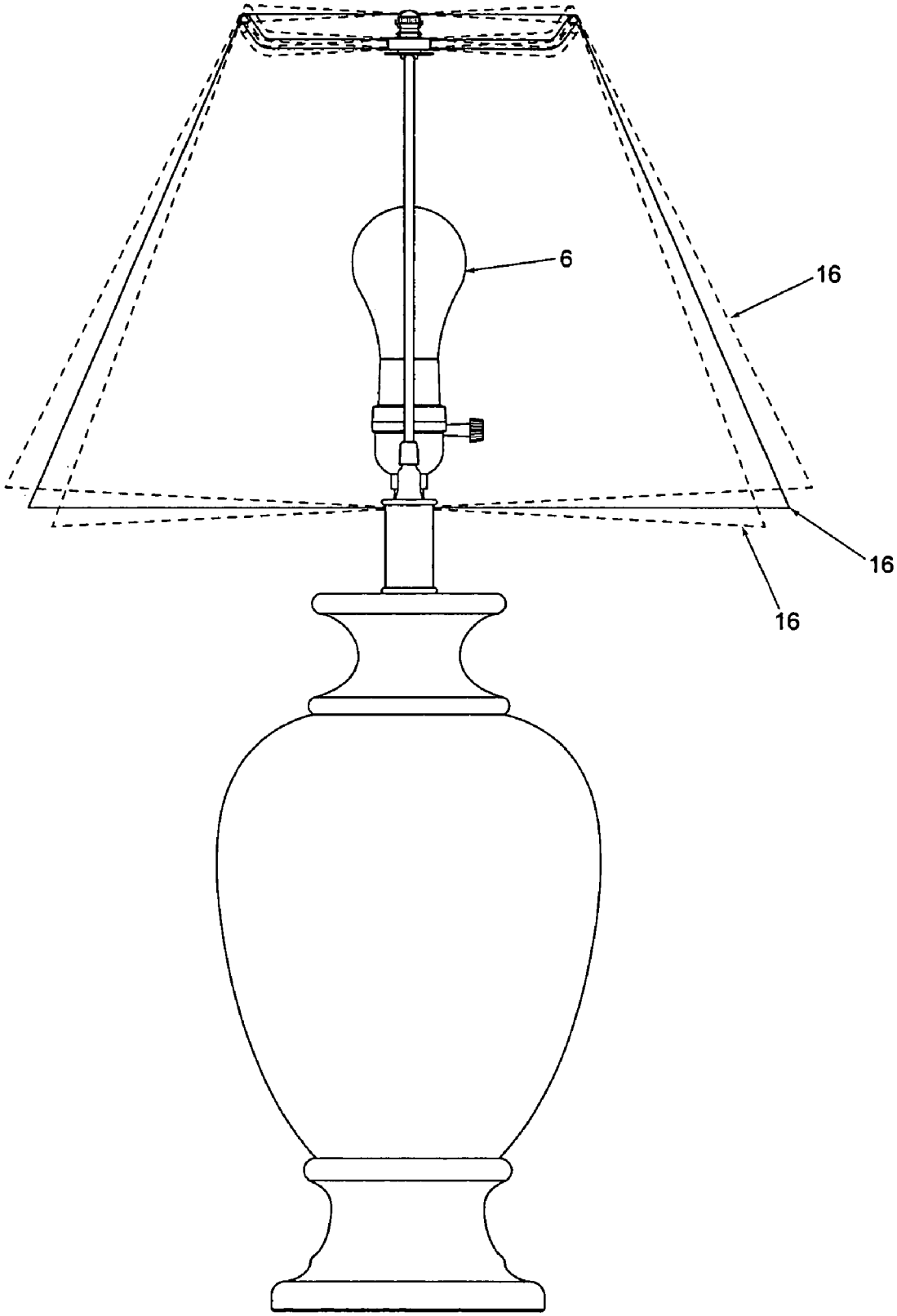
FIG. 11 is a diagram illustrating how the shade leveler of FIG. 6 restricts the movement of a conventional shade attached to a conventional lamp fixture.

Of course, at some point further movement of the shade bracket 16A, the finial 14, and the post 100 in relation to the harp 8 and the shade leveling ring 110 will not be possible due to the shade bracket 16A or the post 100 impinging against the shade leveling ring 110. Consequently, unlike the conventional shade attachment device, the shade 16 will never come to rest in a position where it is too close to the light bulb 6, as shown in FIG. 11.

Although the embodiments of the invention described above possess a shade leveling ring 110 with a dome-shaped profile, many other profiles and shapes are possible depending on the range of motion that the designer wishes to impart to the shade bracket 16A.

Figure 12A:
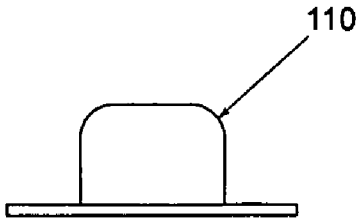
FIGS. 12A and 12B are diagrams illustrating shade leveling rings according to other embodiments of the invention.

For example, raising the dome-shaped portion further from the flattened portion would result in the shade leveling ring 110 shown in FIG. 12A. This design would allow the shade bracket 16A (not shown) a greater degree of movement because of the additional clearance between the shade bracket 16A and the flattened portion of the shade leveling ring 110. Of course, the length of the post 100 would also need to be increased.

Figure 12B:
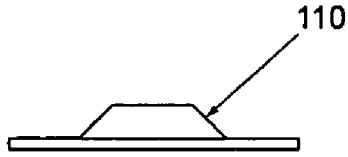

FIG. 12B is a shade leveling ring according to other embodiments of the invention. In this design, the raised portion of the shade leveling ring 110 is substantially cone-shaped.

Other embodiments of the invention may alter the range of motion of the shade bracket 16A by having a shade leveling ring 110 that has a larger diameter hole than the diameter of the post 100. Still other embodiments of the invention may have a shade leveling ring that has a central hole that is not circular, but some other shape that allows more movement in certain directions and less movement in others. For example, the central hole may be substantially star-shaped or cross-shaped.

Figure 13A:
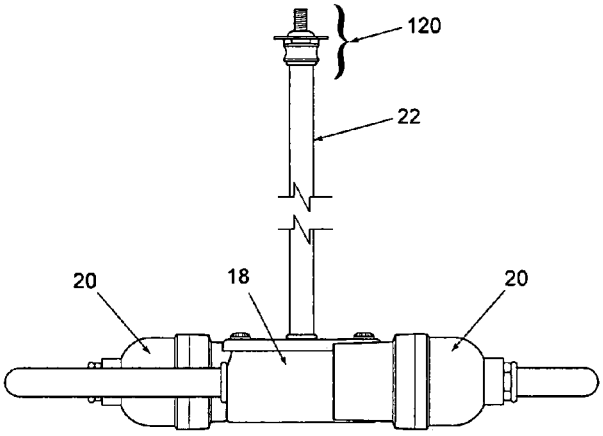
FIGS. 13A and 13B are front and side-view diagrams, respectively, that illustrate other embodiments of the invention that are used with a conventional S-cluster.
Figure 13B:
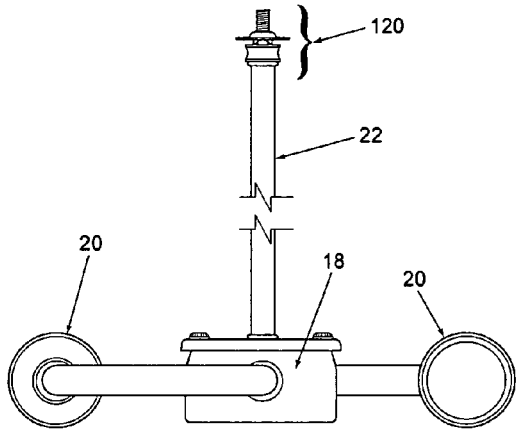

FIGS. 13A and 13B are front and side-view diagrams, respectively, that illustrate other embodiments of the invention that are used with a conventional S-cluster 18. An S-cluster 18 has two sockets 20 that are used to hold lightbulbs (not shown). The S-cluster 18 also includes a riser 22. The shade leveler 120 according to these embodiments of the invention sits atop the riser 22.

Figure 14A:
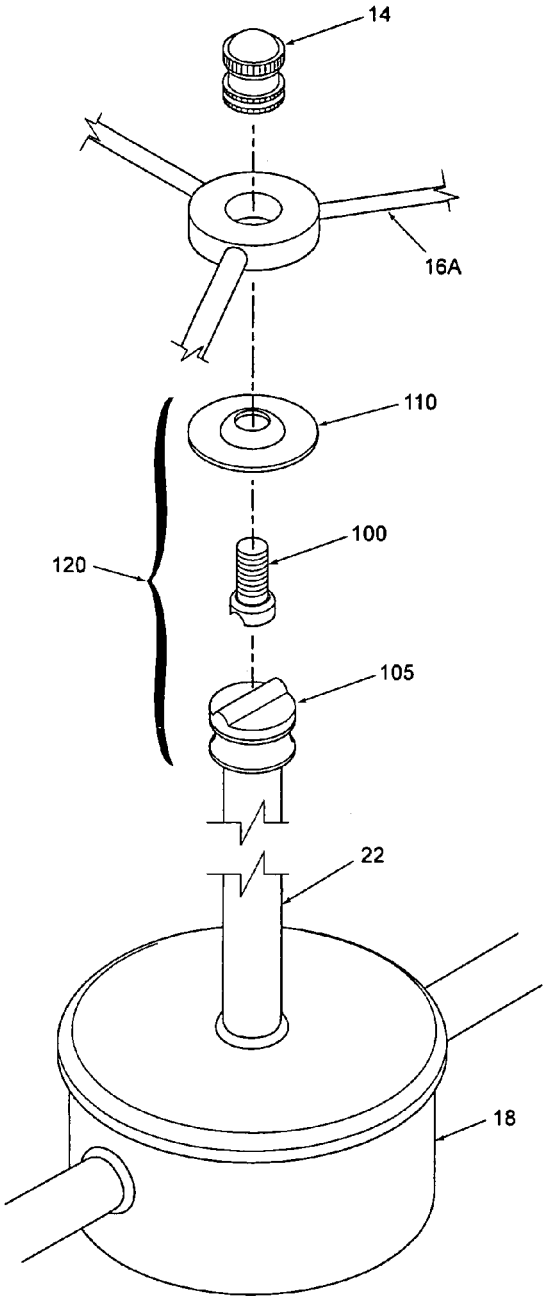
FIGS. 14A and 14B are diagrams illustrating the components of the shade leveler from FIG. 13 according to alternate embodiments of the invention and how those components fit together with relationship to a conventional S-cluster.
Figure 14B:
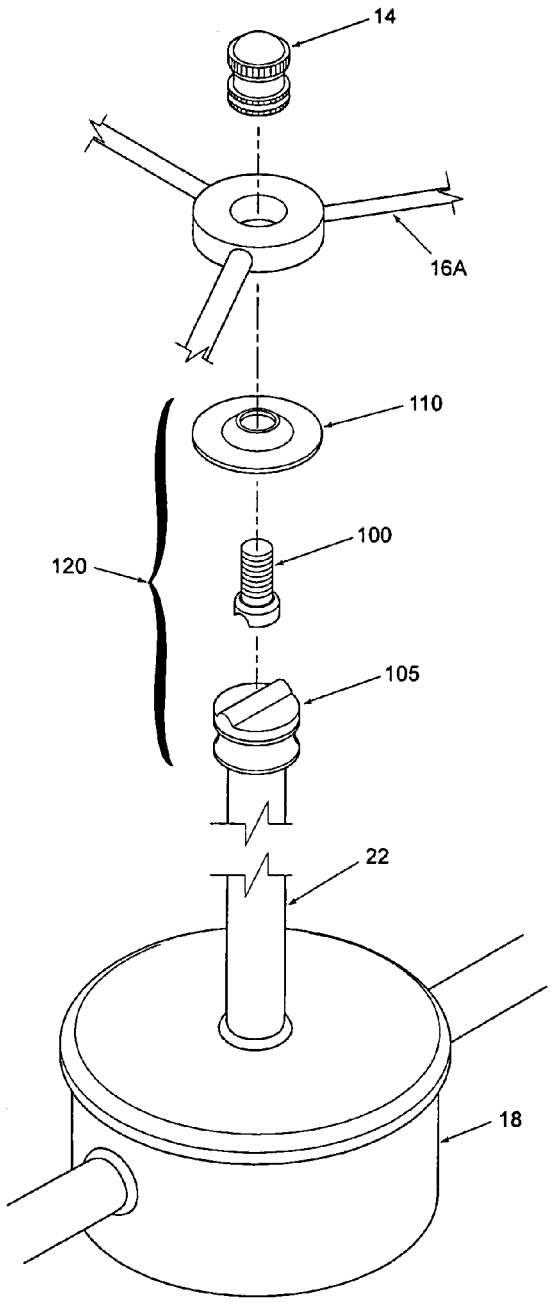

FIGS. 14A and 14B are diagrams illustrating the components of the shade leveler from FIG. 13 according to alternate embodiments of the invention and how those components fit together with relationship to a conventional S-cluster. Like the embodiments described above, the shade leveler 120 includes a post 100 and a shade leveling ring 110.

However, since the conventional S-cluster does not use a harp, the shade leveler 120 also includes a base 105 that has a ridge on top of it. The base 105 is affixed to the top of the riser 22. Like the embodiments explained above, the grooved bottom portion of the post 100 and the ridge on the base 105 interface with each other and allow the finial 14 to be tightened and loosened without turning the post 100. As usual, a conventional shade bracket 16A is held on the post 100 by a conventional finial 14.

While both of the shade leveling rings 110 in FIGS. 14A and 14B are substantially dome-shaped, the shade leveling ring 110 of FIG. 14B has a raised edge at the uppermost portion of the dome, similar to the embodiment illustrated in FIG. 7B.

The base 105, the post 100, and the shade leveling ring 110 may be manufactured from any number of conventionally known materials such as metals, plastics, ceramics, or wood.

Figure 15A:
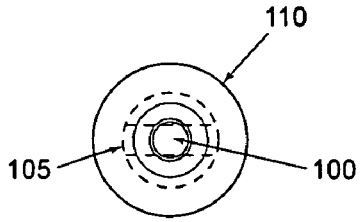
FIGS. 15A–15C are top, front, and side-view diagrams, respectively, that illustrate the components of the shade leveler of FIG. 14A after being assembled and affixed to a conventional riser.
Figure 15B:
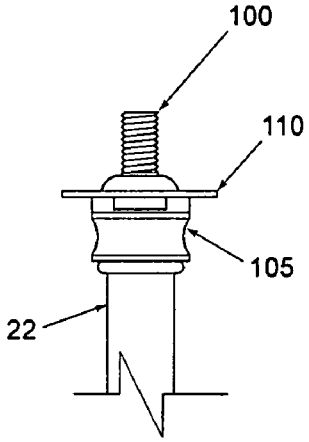
Figure 15C:
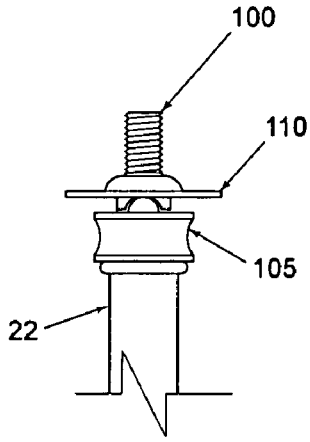

FIGS. 15A–15C are top, front, and side-view diagrams, respectively, that illustrate the components of the shade leveler of FIG. 14A after being assembled and affixed to the riser 22. A flat, outer portion of the shade leveling ring 110 contacts the ridge on the base 105. At this junction the shade leveling ring 110 may be permanently or detachably affixed to the base 105. The contact point between the shade leveling ring 110 and the base 105 is analogous to the contact point between the shade leveling ring 110 and the harp 8 illustrated in FIGS. 8A–8C. The shade leveling ring 110 holds the post 100 loosely against base 105. In other words, no portion of the post is rigidly connected to the base 105. The entire shade leveler 120, once assembled, may be permanently or detachably affixed to the riser 22. The shade leveling ring 110 may be permanently affixed to the base 105 by any number of conventional methods, such as spot welding. The shade leveling ring 110 may also be detachably affixed to the base 105 using any number of conventional methods, such as adhesive or screws.

While the embodiments of the invention described in FIGS. 13, 14, and 15 include an additional component (the base 105) compared to the other embodiments described in this disclosure, the operation of these embodiments is substantially the same as the operation explained above with respect to FIGS. 10 and 11. Thus, for the sake of brevity, the operation of the embodiments illustrated in FIGS. 13, 14, and 15 will not be duplicated here.

Figure 16A:
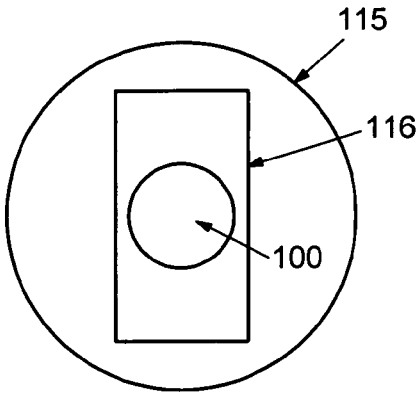
FIGS. 16A and 16B are top-view diagrams illustrating an additional component for a shade leveler according to other embodiments of the invention.
Figure 16B:
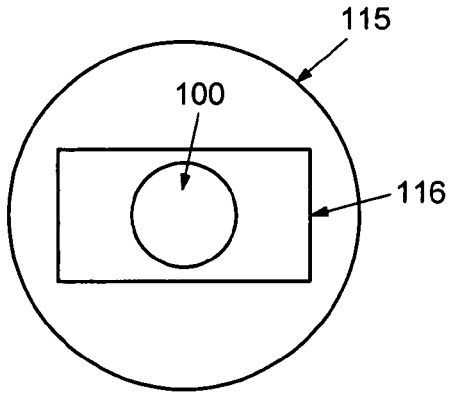

FIGS. 16A and 16B are top-view diagrams illustrating an additional component for a shade leveler according to still other embodiments of the invention. FIGS. 16A and 16B illustrate a finial ring 115. The finial ring 115 has a rectangular slot 116. The slot 116 is configured to allow the post 100 to pass through the center of the finial ring 115.

Figure 17A:
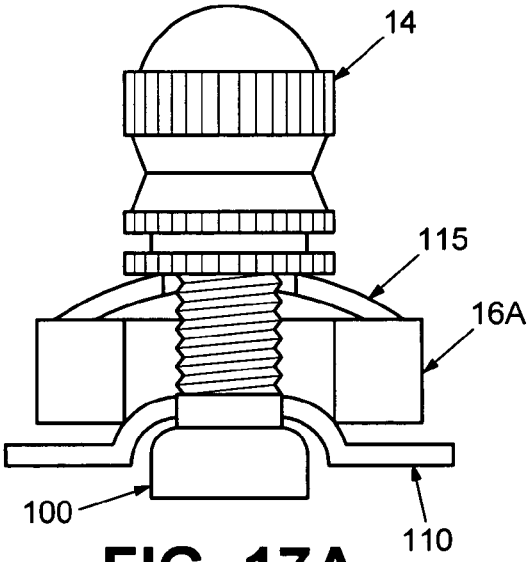
FIGS. 17A and 17B are side-view diagrams illustrating how the additional component of FIGS. 16A and 16B is assembled in relationship to other components of the shade leveler.
Figure 17B:
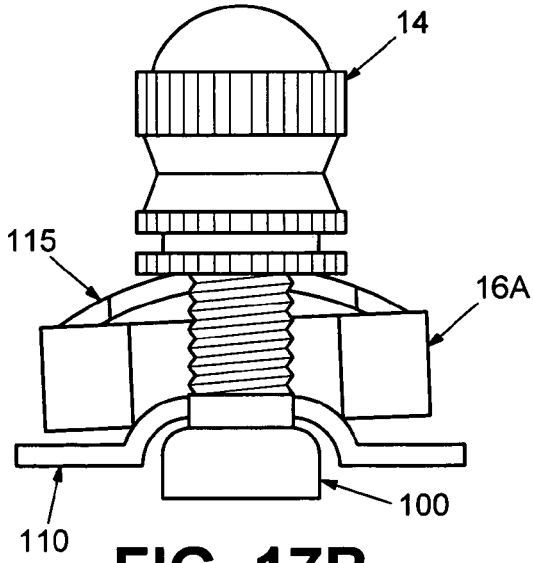

FIGS. 17A and 17B are side-view diagrams corresponding to FIGS. 16A and 16B, respectively, illustrating how the finial ring 115 of FIGS. 16A and 16B is assembled in relationship to other components of the shade leveler. The shade leveling ring 110 holds the post 100 against a harp (not shown). Unlike the embodiments illustrated in FIGS. 6–11, in this case the shade leveling ring 110 is rigidly affixed to the post 100. That is, the shade leveling ring 110 and the post 100 cannot move in relation to each other.

Like the other embodiments described above, a finial 14 is threaded on the post 100 to hold a shade bracket 16A against the dome-shaped portion of the shade leveling ring 110. However, in this case the finial ring 115 is inserted between the shade bracket 16A and the finial 14. The finial ring 115 also has a dome-shaped profile. The dome-shaped profile of the finial ring may or may not be the same as the dome-shaped profile of the shade leveling ring 110.

The finial ring 115 allows the shade bracket 16A to pivot on top of the shade leveling ring 110 even when the post 100 is rigidly affixed to the shade leveling ring 110. The rectangular slot 116 in the finial ring 115 allows the finial ring to move in relationship to the fixed post 100. Without the finial ring 115, the flat bottom surface of the finial 14 would otherwise contact the flat upper surface of the shade bracket 16A, preventing it from sliding on the dome-shaped upper surface of the shade leveling ring 110.

It should be apparent that in the embodiments described in FIGS. 16A, 16B, 17A, and 17B, the range of motion for the shade bracket 16A is additionally limited by the shape of the rectangular slot 116. In other embodiments of the invention, the shape of the slot 116 in the finial ring 115 may be different to allow for other desired ranges of motion. For example, the rectangular slot 116 could be replaced with a circular hole with a diameter larger than that of the post 100. This would allow movement of the shade bracket 16A in all directions.

Alternatively, the opening in the finial ring 115 could be cross-shaped or star-shaped. These examples are not limiting, rather they are just a few examples of the many variations that are possible and contemplated by embodiments of the invention.

Having described and illustrated the principles of the invention in several exemplary embodiments, it should be apparent that the invention can be modified in arrangement and detail without departing from such principles. I claim all modifications and variation coming within the spirit and scope of the following claims.

I claim:

1. A shade leveler comprising:

a threaded post with a groove on one end; and a shade leveling ring having a first raised profile and having a first opening configured to prevent the threaded post from passing completely through the first opening.

2. The shade leveler of claim 1, further comprising:

a finial ring with a second raised profile and a second opening.

3. The shade leveler of claim 2, wherein the finial ring is configured to move in relationship to the threaded post when the shade leveler is assembled.

4. The shade leveler of claim 1, wherein the first raised profile is substantially dome-shaped.

5. The shade leveler of claim 1, wherein the first raised profile is substantially cone-shaped.

6. The shade leveler of claim 1, wherein the shade leveling ring is configured to support a shade bracket.

7. The shade leveler of claim 1, wherein the groove is configured to engage a harp when the post is rotated.

8. The shade leveler of claim 1, further comprising:

a base with a ridge, wherein the shade leveling ring is configured to rigidly connect to the ridge.

9. The shade leveler of claim 8, wherein the groove is configured to engage the ridge when the post is rotated.

10. A shade leveler comprising:

a post; and a washer with, a flat outer portion and a raised inner portion, wherein the washer is configured to move relative to the post when a shade bracket is attached to the post.

11. The shade leveler of claim 10, further comprising:

a finial ring with a raised profile, wherein instead of the washer the finial ring is configured to move relative to the post when the shade bracket is attached to the post.

12. The shade leveler of claim 10, wherein the raised inner portion is substantially dome-shaped.

13. The shade leveler of claim 10, wherein, the raised inner portion is substantially cone-shaped.

14. The shade leveler of claim 10, wherein the washer is configured to allow the shade bracket to tilt in all directions relative to a harp.

15. A method for leveling a tipped shade that is securely attached to a shade supporting device comprising:

returning the shade to a naturally-balanced position on the shade supporting device using only a force that is attributable to the earth's gravity.

16. The method of claim 15, wherein returning the shade to the level position using the natural balancing point of the shade comprises:

attaching the shade to the shade supporting device using a washer that allows the shade to tilt in all directions relative to the shade supporting device.

17. The method of claim 16, wherein attaching the shade to the shade supporting device using the washer comprises:

holding a post loosely against the shade supporting device with the washer, wherein the washer is rigidly affixed to the shade supporting device; and securing the shade to the post.

18. The method of claim 16, wherein the shade supporting device is chosen from the group consisting of a harp and a riser from an S-cluster.

19. The method of claim 17, wherein holding the post loosely against the shade supporting device with the washer comprises:

preventing the post from rotating about a first axis that is perpendicular to a plane of the washer and that passes through a center of the washer; and allowing a second axis running longitudinally through the post to become non-parallel with respect to the first axis.

20. A shade leveler for a light fixture having at least one light bulb, the shade leveler comprising:

an attachment device structured to securely attach a shade to a shade supporting device, the shade supporting device structured to support the shade; and a self-leveling apparatus, the self-leveling apparatus structured to prevent the shade from contacting the at least one light bulb, the self-leveling apparatus structured to return the shade to a level position on the shade supporting device after the shade has been displaced from the level position, and the self-leveling apparatus structured to return the shade to the level position without manual adjustment of the self-leveling apparatus.

21. A method for leveling a tipped shade that is securely attached to a shade supporting device, the method comprising:

returning the shade to a level position using a natural balancing point of the shade, wherein returning the shade to the level position includes attaching the shade to the shade supporting device using a ring that allows the shade to tilt in all directions relative to the shade supporting device, wherein attaching the shade to the shade supporting device includes holding a post loosely against the shade supporting device with the ring and securing the shade to the post, wherein the ring is rigidly affixed to the shade supporting device.

22. The method of claim 21, wherein holding the post loosely against the shade supporting device with the ring comprises:

preventing the post from rotating about a first axis that is perpendicular to a plane of the ring and that passes through a center of the ring; and allowing a second axis running longitudinally through the post to become non-parallel with respect to the first axis.

* * * * *